US005851165A

United States Patent [19]

Wei et al.

[11] Patent Number: 5,851,165

[45] Date of Patent: Dec. 22, 1998

[54] WHEEL-TYPE RESISTANCE DEVICE FOR A BICYCLE EXERCISER

[76] Inventors: Mike Wei, No. 229, Lane 75, Sec. 3, Kang-Ning Rd., Nei-Hu Dist., Taipei City; Sheng-Jung Wu, No. 64, Alley 60, Lane 632, Sec. 3, Chang-Hsin Rd., Ho-Mei Chen, Chang-Hua Hsien, both of Taiwan

[21] Appl. No.: 89,852

[22] Filed: Jun. 3, 1998

[51] Int. Cl.[6] ..... A63B 22/06; B60L 7/00

[52] U.S. Cl. ..... 482/63; 188/164

[58] Field of Search ..... 482/57, 63, 903, 482/5, 6; 188/161, 163, 164, 267; 310/93, 105, 153; 123/697

[56] References Cited

U.S. PATENT DOCUMENTS

| | | | |
|---|---|---|---|
| 4,146,806 | 3/1979 | Katsumata | 310/153 |
| 4,550,697 | 11/1985 | Campen | 123/149 D |
| 5,072,930 | 12/1991 | Sun | 482/903 |
| 5,236,069 | 8/1993 | Peng | 482/903 |
| 5,247,854 | 9/1993 | Wa | 482/63 |
| 5,254,061 | 10/1993 | Leask | 482/903 |
| 5,437,353 | 8/1995 | Wu | 188/164 |
| 5,586,624 | 12/1996 | Ko et al. | 482/63 |
| 5,711,404 | 1/1998 | Lee | 188/164 |

*Primary Examiner*—Stephen R. Crow
*Attorney, Agent, or Firm*—Christensen O'Connor Johnson & Kindness PLLC

[57] ABSTRACT

A wheel-type resistance device includes a flywheel rotated with a hub member around an axle and having an accommodation chamber with a first circumferential portion extending in a radial direction and provided with a plurality of magnetically attractive members. A dragging force adjusting member is mounted on the axle and has a second circumferential portion registered with the first circumferential portion. Upper and lower magnetic members are disposed movably on the second circumferential portion and are spaced apart from and are in symmetry with each other relative to a horizontal line transverse to an axial direction defined by the axle. A cam member is mounted rotatably on the axle. A pair of cam followers are disposed respectively on the upper and lower magnetic members and are moved by the cam member such that counterclockwise rotation of the cam member will impart linear movements of the upper and lower magnetic members towards the horizontal line. As such, the overlapping area of the upper and lower magnetic members with the second circumferential portion can be decreased.

10 Claims, 5 Drawing Sheets

WHEEL-TYPE RESISTANCE DEVICE FOR A BICYCLE EXERCISER

BACKGROUND OF THE INVENTION

1. Field of the Invention

This invention relates to a resistance device for a bicycle exerciser, more particularly to a wheel-type resistance device which can provide an even magnetic resisting force between a flywheel and a dragging force adjusting member thereof.

2. Description of the Related Art

Referring to FIGS. 1 and 2, a conventional wheel-type resistance device for a bicycle exerciser includes a flywheel 2 which is sleeved rotatably on an axle 1. The flywheel 2 has an accommodation chamber 2*a* which is indented axially to form an inner peripheral wall around the axle 1 on which two magnetically permeable members 3 are secured angularly. A dragging force adjusting member 4 is received in the chamber 2*a*, and includes a plate member 5 with an annular groove 5*a* at its outer periphery. An elongate sliding slot 5*d* extends radially and inwardly from the annular groove 5*a*. Two connecting holes 5*b* are formed diametrically opposite to the sliding slot 5*d* relative to the axle 1 for mounting slidably a sliding seat 7. Two mounting holes 5*e* extend radially and inwardly from the annular groove 5*a* at opposite sides of the sliding slot 5*d* to receive respectively two springs 5*f*. Each of two fastening plates 6 has a first end pivoted to the respective connecting hole 5*b*, and a second end extending adjacent to the sliding slot 5*d* to connect with a guiding cord 8 which in turn is connected to the sliding seat 7 via a pulley 5*c*. Each fastening plate 6 has an outer peripheral wall which is provided with two magnets 9,9' thereon opposite to the magnetically permeable members 3, and an inner peripheral wall which is biased by the respective spring 5*f*. When the flywheel 2 is rotated relative to the adjusting member 4, the magnets 9,9' are drawn by the magnetically permeable members 3 to generate a magnetic dragging force.

A cable 7*a*, which is connected to the sliding seat 7, is pulled to move the sliding seat 7 along the sliding slot 5*d* so as to swing the second ends of the fastening plates 6 relative to the first ends. As such, the fastening plates 6 are moved radially and inwardly so as to move the magnets 9,9' away from the magnetically permeable members 3 to decrease the magnetic dragging force therebetween. The springs 5*f* bias the fastening plates 6 toward the flywheel 2 against the action of the cable 7*a*.

The drawbacks of the conventional resistance device are as follows:

1. The clearance between the magnet 9 and the opposing magnetically permeable member 3 is larger than that between the magnet 9' and the opposing magnetically permeable member 3 when the second ends of the fastening plates 6 are drawn relative to the first ends to move the magnets 9,9' away from the flywheel 2, thereby resulting in an uneven magnetic dragging force therebetween.

2. Each of the magnetically permeable members 3 and the fastening plates 6 is bent to be semi-circular in shape, thereby resulting in increased difficulties during manufacture and assembly.

SUMMARY OF THE INVENTION

The object of the present invention is to provide a wheel-type resistance device that can provide an even magnetic resisting force for a bicycle exerciser and that is relatively easy to manufacture and assemble.

According to this invention, a wheel-type resistance device includes a flywheel rotated with a hub member around an axle and having an accommodation chamber with a first circumferential portion which is provided with a plurality of magnetically attractive members. A dragging force adjusting member-is mounted on the axle and has a second circumferential portion registered with the first circumferential portion. Upper and lower magnetic members are disposed movably on the second circumferential portion and are spaced apart from and are in symmetry with each other relative to a horizontal line transverse to an axial direction defined by the axle. A cam member is mounted rotatably on the axle. A pair of cam followers are disposed respectively on the upper and lower magnetic members and are moved by the cam member such that counterclockwise rotation of the cam member will impart linear movements of the upper and lower magnetic members towards the horizontal line. As such, the overlapping area of the upper and lower magnetic members with the second circumferential portion can be decreased. Since the linear movements of the upper and lower magnetic members are even by guidance of the cam surfaces and the cam followers, the adjustment of the magnetic resisting force is both even and smooth.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
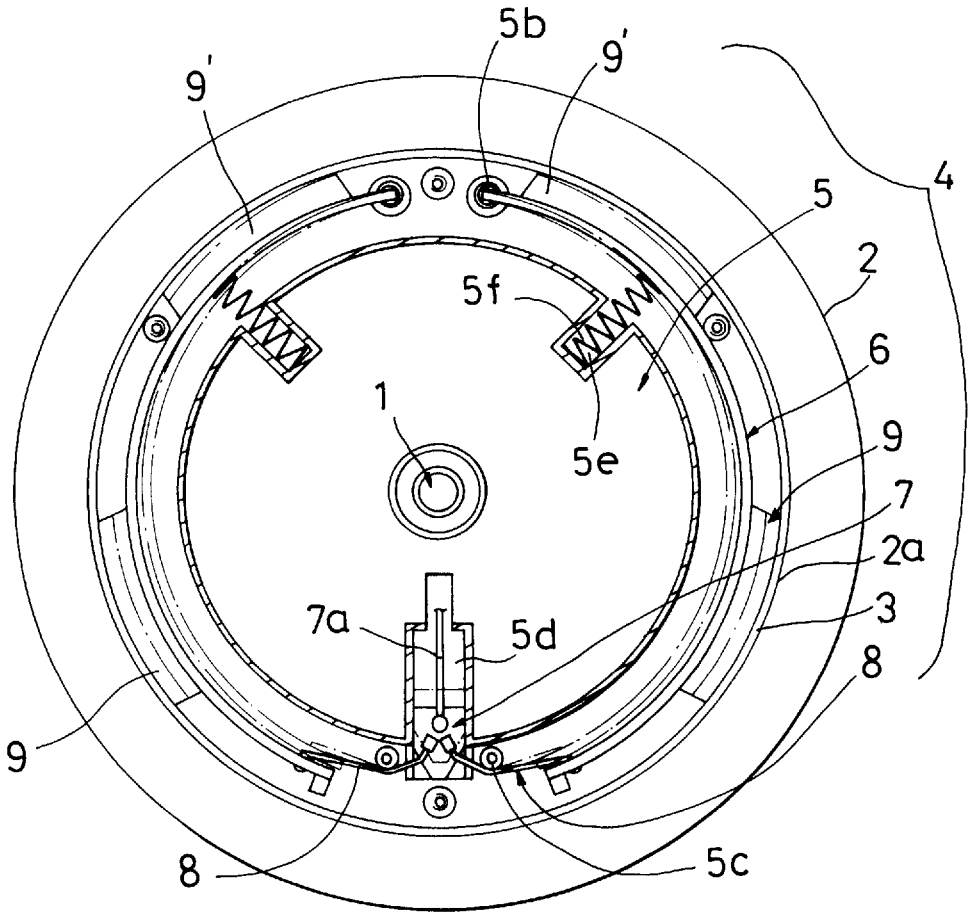
FIG. 1 PRIOR ART
FIG. 1 is a front sectional view of a conventional wheel-type resistance device of a bicycle exerciser.
Figure 2:
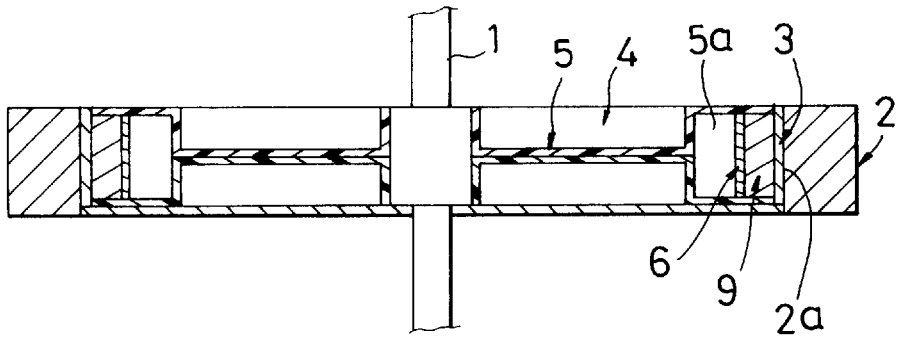
FIG. 2 PRIOR ART
FIG. 2 is a side sectional view of the conventional resistance device.
Figure 3:
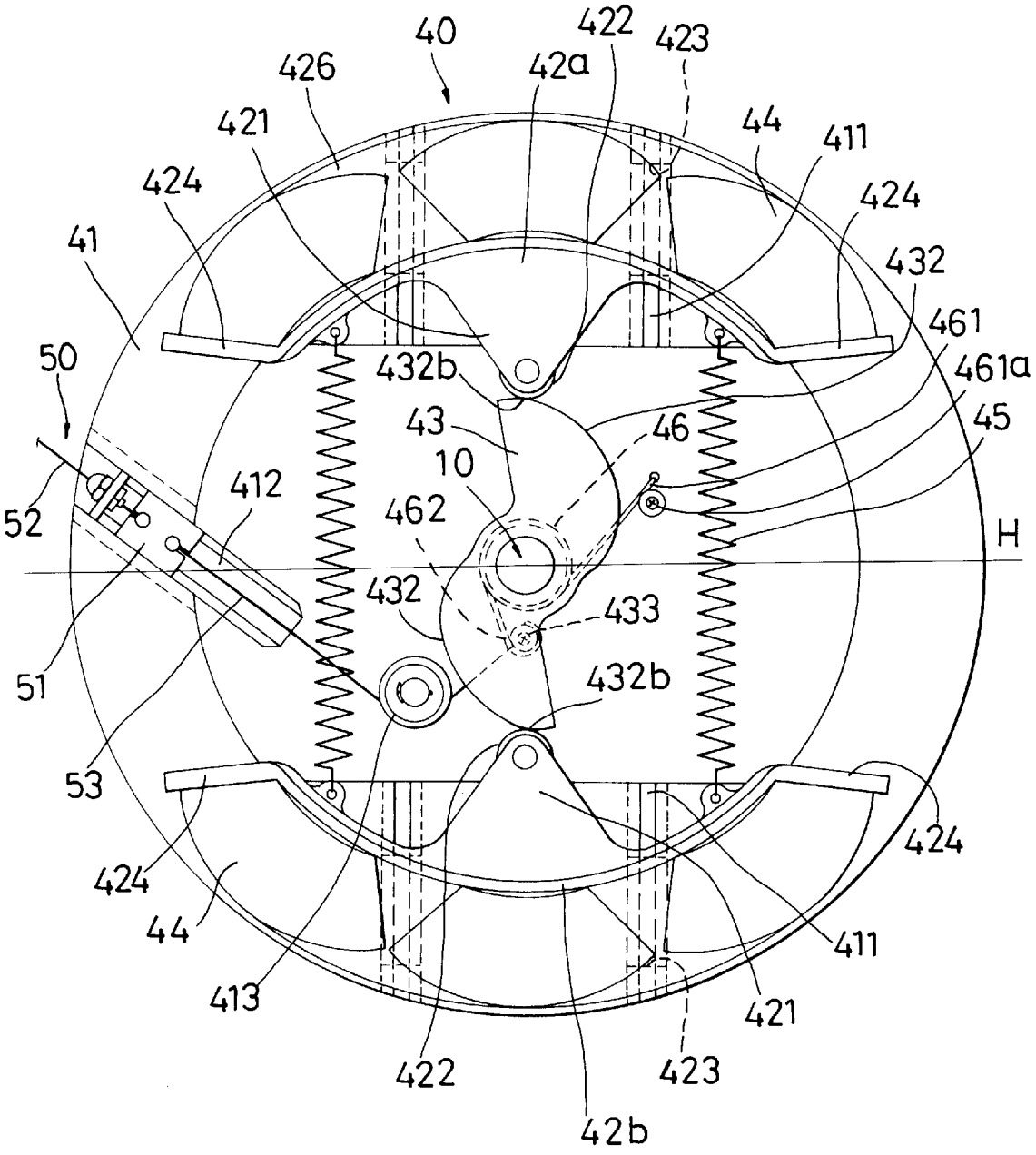
FIG. 3 is a front schematic view of a preferred embodiment of a wheel-type resistance device according to this invention in a state where the magnetic resisting force is largest.
Figure 4:
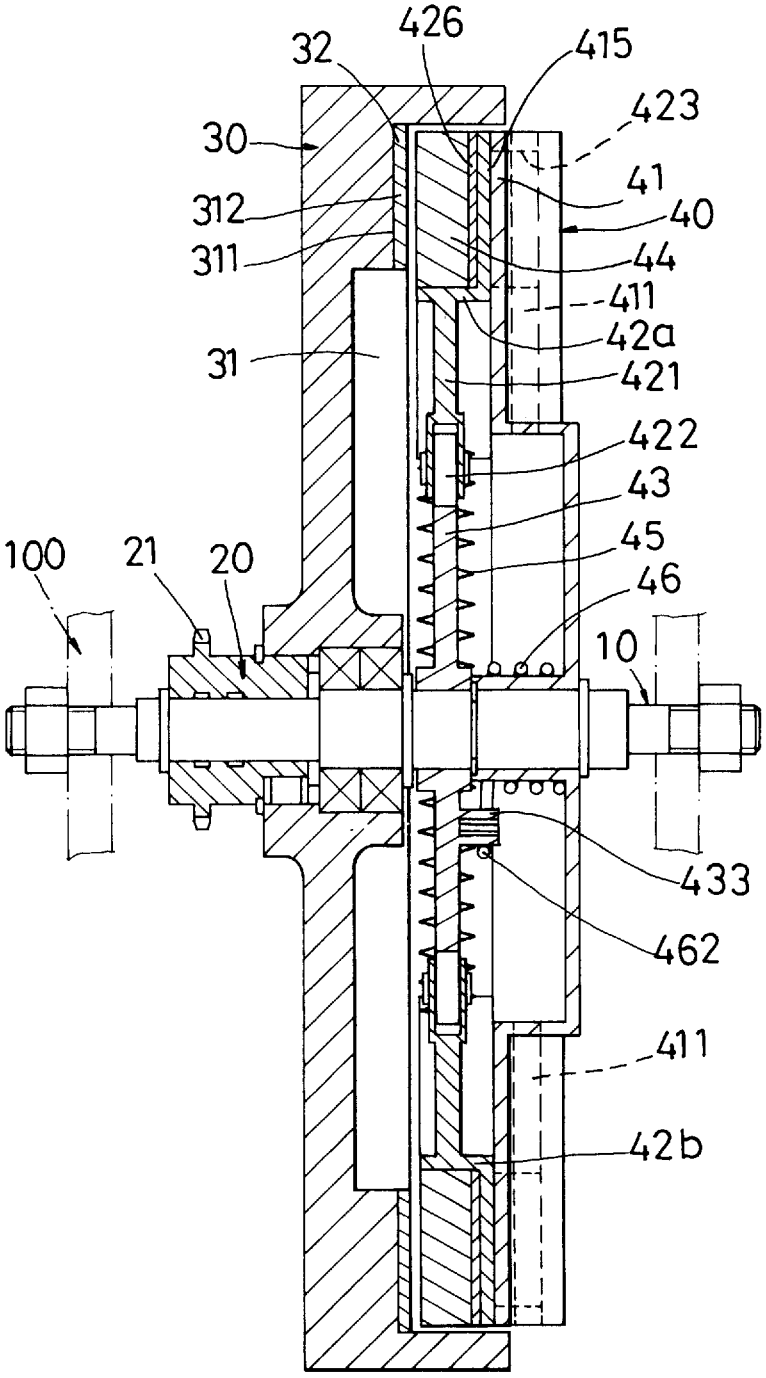
FIG. 4 is a side sectional view of the preferred embodiment showing how the resistance device is mounted on the axle of an exerciser.

Referring to FIGS. 3 and 4, the preferred embodiment of a wheel-type resistance device according to the present invention is shown to be mounted on axle 10 which is secured on a bicycle exerciser frame 100. The resistance device is shown to comprise a flywheel 30, a dragging force adjusting member 40, upper and lower magnetic members, a cam member 43, a first biasing member, a second biasing member, and a tensioning member 50.

The flywheel 30 is made of a magnetically attractive material, such as iron, and is mounted rotatably on the axle 10 for rotation together with a hub member 20 via a chain wheel 21 which is driven to rotate by a pedaling action of a user (this is known in the prior art). The flywheel 30 has a left end wall proximate to the hub member 20, and a right end wall with an accommodation chamber 31 indented axially and leftward so as to form a dragging force generating wall which is spaced apart from the right end wall and which has a first circumferential portion 311 extending in a radial direction relative to the axle 10. Four magnetically attractive members 312 are angularly provided on the first circumferential portion 311. Four arcuate magnetically permeable members 32, which are made of aluminum, are disposed on the magnetically attractive members 312.

The dragging force adjusting member 40 includes a circular plate body 41 which is made of a plastic material and which is mounted on the axle 10. The plate body 41 has a right major surface and a left major surface which is spaced apart from and opposing the dragging force generating wall of the flywheel 30 and which is provided with a second circumferential portion 415 that is registered with the first circumferential portion 311. Two elongate slots 411 are formed in the plate body 41 and are spaced apart from and extend parallel to each other in a transverse direction to serve as keyways. An elongate sliding groove 412 is also formed in the plate body 41.

Figure 5:
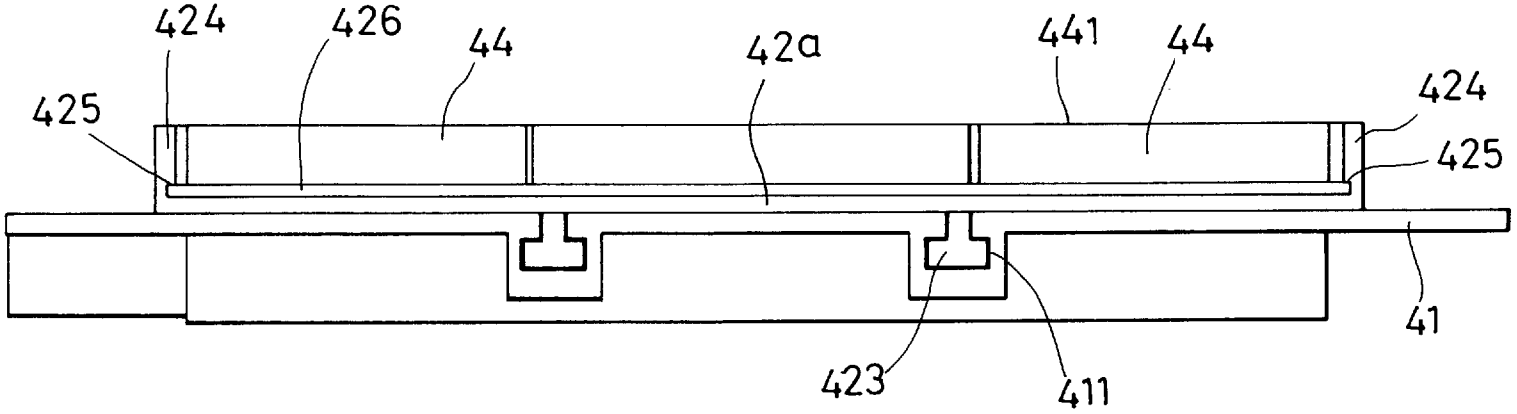
FIG. 5 is a schematic view showing how magnets are mounted on a dragging force adjusting member of the preferred embodiment.

The upper and lower magnetic members are spaced apart from and are in symmetry with each other relative to a horizontal line (H) transverse to the axial direction of the axle 10. The upper and lower magnetic members include upper and lower mounting members 42*a*, 42*b* which are disposed movably on the second circumferential portion 415 and which define upper and lower magnetic zones with upper and lower leading and tailing ends 424, respectively. The upper leading and tailing ends 424 are diametrically opposite to the lower leading and tailing ends 424, respectively. Each of the mounting members 42*a*, 42*b* has a projecting portion 421 which extends toward the horizontal line (H) for mounting a cam follower 422 thereon. The cam followers 422 are positioned in a middle line which passes through the axis of the axle 10 and which is disposed between the upper leading and upper tailing ends 424 and between the lower leading and lower tailing ends 424. Two elongate protrusions 423 are formed respectively on the mounting members 42*a*, 42*b* equidistant to the middle line so as to serve as keys that engage slidably the elongate slots 411. With reference to FIG. 5, each of the leading and tailing ends 424 projects from the mounting member 42*a*, 42*b* to form an engaging cavity 425 so as to engage an anchoring member 426 which is made of a magnetically attractive material so as to assist in the mounting of a plurality of arcuate magnets 44 onto the mounting member 42*a*, 42*b*. The magnets 44 have magnetically attractive surfaces 441 opposite to the magnetically permeable members 32.

The cam member 43 is mounted rotatably on the axle 10 and has two cam surfaces 432 which extend diametrically opposite to each other relative to the axle 10 in order to engage the cam followers 422. A projecting stem 433 is form on the cam member 43.

The first biasing member includes two tension springs 45 which are connected respectively to the upper and lower mounting members 42*a*, 42*b* and which extend parallel to each other in the transverse direction at opposite sides of the cam member 43 so as to bias the cam followers 422 to engage slidably the cam surfaces 432. In addition, the tension springs 45 provide a biasing force for the upper and lower mounting members 42*a*, 42*b* toward the horizontal line (H) when the cam followers 422 engage the first angular position 432*b* of the cam surfaces 432 to actuate the cam member 43 to rotate counterclockwise.

The second biasing member is a torsion spring 46 which is sleeved on the axle 10 and which has an end 461 secured on the plate body 41 by a fastener 461*a* and an opposite end 462 secured to the projecting stem 433. As such, the torsion spring 46 can provide a biasing force to the cam member 43 for counteracting the biasing action of the tension springs 45.

The tensioning member 50 includes a sliding seat 51 which is mounted slidably in the sliding groove 412, a connecting cord 53 which interconnects the cam member 43 and one end of the sliding seat 51 and which is trained on a pulley member 413 that is mounted on the plate body 41, and a cable 52 which has a fixed end connected to the other end of the sliding seat 51 and a free end adapted to be mounted on an actuating switch of the bicycle exerciser (not shown). As such, a pulling force can be applied on the cable 52 to result in a clockwise angular replacement of the cam member 43 for counteracting the biasing action of the tension springs 45. Therefore, by the virtue of the tensioning springs 45, the torsion spring 46, and the tensioning member 50, the cam member 43 is retained against rotation.

In the state of the resistance device shown in FIG. 3, the tension springs 45 and the torsion spring 46 have been tensed and twisted to apply the biasing force for counterclockwise angular replacement of the cam member 43 and the pulling force for clockwise angular replacement of the cam member 43, respectively. Each of the cam followers 422 is lifted to a farthest position relative to the horizontal line (H) so that the overlapping area of the magnets 44 with the second circumferential portion 415 is largest. When the chain wheel 21 drives the flywheel 30 to rotate, the magnetic forces of the magnets 44 permeate through the magnetically permeable members 32 to provide a magnetic dragging force to the flywheel 30. As such, a larger pedaling force must be applied to counter the dragging force, thereby achieving an exercising effect.

Figure 6:
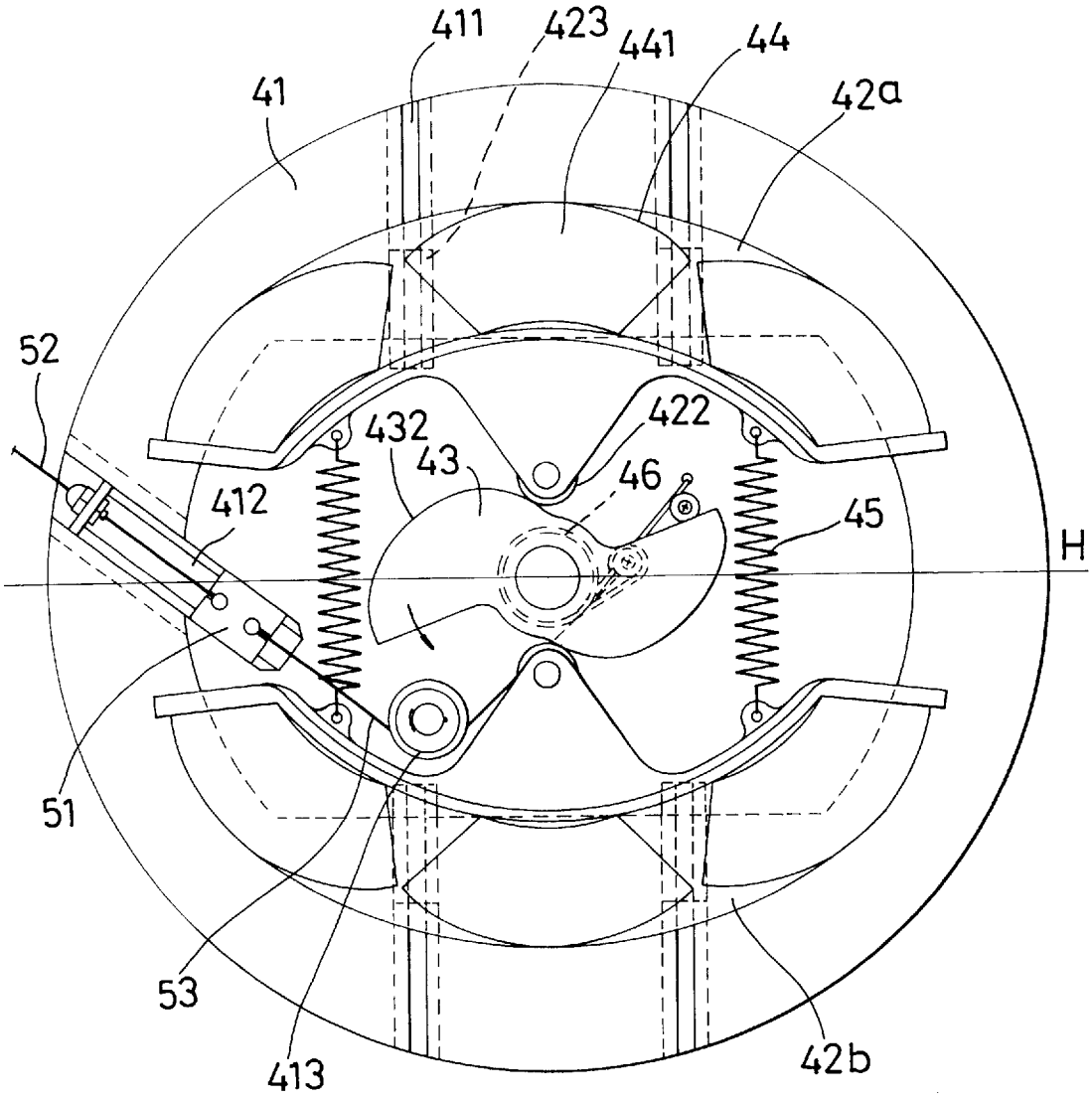
FIG. 6 is a front schematic view of the preferred embodiment in a state where the magnetic resisting force is smallest.

Referring to FIG. 6, when the cable 52 is released by turning the actuating switch (not shown) to move the sliding seat 51 along the sliding groove 412 toward the pulley member 413, the pulling force of the torsion spring 46 is decreased so that the cam member 43 is displaced counterclockwise to initiate the movement of the cam followers 422 along the cam surfaces 432, thereby imparting linear movement of the mounting members 42*a*, 42*b* toward the horizontal line(H) along the transverse direction with assistance of the tension springs 45. As such, the overlapping area is decreased so that the magnetic dragging force can be correspondingly decreased to accommodate a variety of exercising requirements. FIG. 6 shows the resistance device providing a smallest magnetic dragging force.

As illustrated, even linear movements of the upper and lower mounting members 42*a*, 42*b* in the transverse direction are ensured by the guidance of the cam member 43 and the cam surfaces 432 so that the opposing distances between the magnets 44 and the corresponding magnetically permeable members 32 are equal, thereby generating an even magnetic dragging force. In addition, by virtue of the tension springs 45, the upper and lower mounting members 42*a*, 42*b* can be moved conveniently.

It is apparent that each of the magnetically permeable members 32 is shaped a flat plate, thereby simplifying the manufacture and assembly thereof.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. A wheel-type resistance device for providing a resisting force to a bicycle exerciser which includes an axle defining an axial direction, and a hub member mounted rotatably on the axle and driven to rotate by a pedaling action of a user, said wheel-type resistance device comprising:

a flywheel having left and right end walls, said flywheel being adapted to be mounted rotatably on the axle such that said left end wall is proximate to and is rotated together with the hub member around the axle, and such that said right end wall is distal to the hub member, said right end wall having an accommodation chamber therein indented axially and leftward so as to form a dragging force generating wall which is spaced apart from said right end wall in the axial direction and which has a first circumferential portion extending in a radial direction relative to the axle;

a plurality of magnetically attractive members angularly provided on said first circumferential portion;

a dragging force adjusting member adapted to be mounted on the axle and having a right major surface and a left major surface which is spaced apart from and opposing said dragging force generating wall and which is provided with a second circumferential portion that is registered with said first circumferential portion;

upper and lower magnetic members disposed movably on said second circumferential portion and defining respectively upper and lower magnetic zones with upper and lower leading and tailing ends respectively, said upper leading and tailing ends being diametrically opposite to said lower tailing and leading ends respectively so that said upper and lower magnetic members are spaced apart from and are in symmetry with each other relative to a horizontal line that is transverse to the axial direction;

a cam mechanism including a cam member adapted to be mounted rotatably on the axle and having a pair of cam surfaces disposed diametrically opposite to each other, and a pair of cam followers disposed respectively on said upper and lower magnetic members and engaged movably and respectively by said cam surfaces such that a counterclockwise angular displacement of said cam member will impart linear movements of said upper and lower magnetic members towards the horizontal line along a transverse direction relative to the horizontal line;

a first biasing member disposed to bias said cam followers to engage movably and respectively said cam surfaces; and a tensioning member having a proximate end fixed at said cam member and a distal end mounted on said dragging force adjusting member such that a pulling force applied on said tensioning member will result in a clockwise angular displacement of said cam member for counteracting biasing action of said first biasing member to retain each of said cam surfaces at a first angular position, where said cam followers are lifted to a farthest position relative to the horizontal line, and where overlapping area of said upper and lower magnetic members with said second circumferential portion is largest; and a second biasing member disposed to bias against the pulling force applied on said tensioning member so as to place said tensioning member in a tense state when said tensioning member counteracts the biasing action of said first biasing member;

whereby, a decrease in the pulling force applied on said tensioning member will result in the counterclockwise angular displacement of said cam member, thereby decreasing the overlapping area of said upper and lower magnetic members with said second circumferential portion.

2. The wheel-type resistance device according to claim 1, wherein each of said cam followers is positioned in a middle line which passes through an axis of the axle and which is disposed between said upper leading and upper tailing ends and between said lower leading and lower tailing ends.

3. The wheel-type resistance device according to claim 2, further comprising a pair of keys disposed on each of said upper and lower magnetic members and spaced apart from each other equidistant to the middle line, and a pair of keyways disposed on said dragging force adjusting member and spaced apart from and extending parallel to each other in the transverse direction and towards the horizontal line so as to receive and guide respectively said keys to ensure the linear movement of said upper and lower magnetic members towards the horizontal line.

4. The wheel-type resistance device according to claim 1, wherein said second biasing member is a torsion spring adapted to be sleeved on the axle.

5. The wheel-type resistance device according to claim 1, wherein said first biasing member includes a pair of tension springs each of which is connected between upper and lower magnetic members and extends parallel to each other in the transverse direction.

6. The wheel-type resistance device according to claim 1, wherein said tensioning member includes a sliding groove formed in said dragging force adjusting member, a sliding seat mounted slidably in said sliding groove to form said distal end, a connecting cord having a first end to form said proximate end mounted fixedly on said cam member and a second end connected to said sliding seat, and a cable having a fixed end connected to said sliding seat and a free end adapted to be mounted on the bicycle exerciser so as to regulate the pulling force of said tensioning member.

7. The wheel-type resistance device according to claim 6, wherein said tensioning member further includes a pulley member mounted on said dragging force adjusting member between said sliding groove and said cam member for training of said connecting cord thereon.

8. The wheel-type resistance device according to claim 1, wherein each of said upper and lower magnetic members includes a mounting member disposed movably on said second circumferential portion, and a plurality of magnets secured on said mounting member.

9. The wheel-type resistance device according to claim 8, wherein each of said upper and lower magnetic members further includes an anchoring member made of magnetically attractive material and mounted between said mounting member and said magnets for attracting said magnets thereon so as to assist in mounting of said magnets onto said mounting member.

10. The wheel-type resistance device according to claim 1, further comprising a plurality of magnetically permeable members disposed on said magnetically attractive members.

* * * * *